United States Patent [19]

Marchetti

[11] 4,275,543

[45] Jun. 30, 1981

[54] AUTOMATIC MACHINE FOR CLOSING THE LOWER FLAPS OF A PARALLELEPIPED BOX WITH FOLDABLE FLAPS, AND FOR RETAINING THE BOX IN A FILLING POSITION

[76] Inventor: Augusto Marchetti, Piazza Sicilia 7, Milan, Italy

[21] Appl. No.: 100,753

[22] Filed: Dec. 5, 1979

[30] Foreign Application Priority Data

May 23, 1979 [IT] Italy ..... 22922 A/79

[51] Int. Cl.[3] ..... B31B 5/26; B31B 1/52

[52] U.S. Cl. ..... 53/374; 493/183

[58] Field of Search ..... 53/374, 375, 207; 93/49 AC, 49 R, 49 M, 41, 36.3, 36.9

[56] References Cited

U.S. PATENT DOCUMENTS

| | | | |
|---|---|---|---|
| 2,739,513 | 3/1956 | Dobson | 53/374 X |
| 3,648,574 | 3/1972 | Luke | 93/49 AC |
| 3,690,222 | 9/1972 | Schroeder | 53/374 X |
| 4,179,866 | 12/1979 | Graham et al. | 53/374 X |
| 4,215,522 | 8/1980 | Clift et al. | 53/374 X |

*Primary Examiner*—James F. Coan

*Attorney, Agent, or Firm*—Karl W. Flocks

[57] ABSTRACT

This invention relates to an automatic machine for closing the lower flaps of a parallelepiped box with foldable flaps and for then retaining the box in a position suitable for its filling with the product to be packaged. The machine according to the invention comprises a T section, a pair of parallel bars disposed in front of said section and a pair of lateral plates, all of which can be rotated sequentially from respective rest positions to respective work position in order to close sequentially the end lower flaps and the lateral lower flaps of a parallelepiped box.

6 Claims, 8 Drawing Figures

AUTOMATIC MACHINE FOR CLOSING THE LOWER FLAPS OF A PARALLELEPIPED BOX WITH FOLDABLE FLAPS, AND FOR RETAINING THE BOX IN A FILLING POSITION

This invention relates to an automatic machine for closing the lower flaps of a parallelepiped box with foldable flaps, and for then retaining the box in a position suitable for its filling with the product to be packaged.

Certain parallelepiped boxes, usually of cardboard, comprise four foldable lower flaps and four foldable upper flaps for their closure. More precisely, each group of four flaps comprises two end flaps and two side flaps which are folded after the first two. A longitudinal gap remains between the two folded side flaps, which is then completed and sealed by a suitable strip of adhesive tape.

The lower flaps of such boxes are normally closed manually before filling, which takes place with the box simply resting on a support surface and not yet provided with the lower sealing tape. This often gives rise to drawbacks such as the lateral overturning of the box and the loss of part of the product to be packaged.

Devices are known which aid the operator in closing the lower flaps and then retain the box in position during its filling. However, these are devices which rely completely on the action of the operator, and to some extent on his ability and physical strength, without for their part being in any way automated.

The object of the present invention is to provide a machine which, while limiting the action of the operator to a minimum, automatically carries out an entire series of movements capable of closing the lower flaps of a parallelepiped box, and then retaining the box in a position suitable for its filling with the product or products to be packaged.

According to the invention, this object is attained by a machine comprising a T section with a vertical lower branch, which can be rotated from a rest position in which its upper branch is inclined downwards, to a working position in which said upper branch extends horizontally, a pair of parallel bars disposed in front of said section at a distance apart such as not to hinder the rotation of the section and which themselves can be axially displaced from a rest position in which they extend obliquely from a support structure converging towards said section, to a working position in which they are withdrawn towards said support structure, a pair of lateral plates rotatable from a rest position in which they are disposed vertically to the sides of said section and said bars, to a working position in which they converge horizontally towards said section so that when the section is in its working position they are disposed below the upper branch and to the sides of the lower branch of said section, first sensitive means which, when a box with its lower flaps open is arranged above said section and said bars such that its major sides are in planes parallel to the axes of said section and said bars, responds so as to cause said section to rotate from said rest position to said working position in order to close the end flaps of the box, second sensitive means which, when the section rotates into said working position, respond so as to cause said bars to move from said rest position to said working position, and third sensitive means which, when said bars move into said working position, respond so as to cause said lateral plates to rotate from said rest position to said working position in order to close the side flaps of the box under said end flaps.

In other words, the machine according to the invention is based firstly on the presence of the T section which, when in its initial inclined position, and in collaboration with the bars situated in front of and converging towards it, gives an inducing prefold to the end flaps, and then as soon as the first sensitive means have sensed the position of the box, rotates so as to close the end flaps. No particular strength or specialist action is required during this stage from the operator, who need do nothing more than watch the machine which completely automatically withdraws the bars from a position which would hinder the rotation of the lateral plates, and then rotates the lateral plates in order to close the side flaps. At this point, the box has its lower flaps closed, and is retained by the section and the lateral plates in a position from which it cannot be easily disturbed, and which is suitable for its filling with the product to be packaged. After the box has been filled, it can be removed from the machine, possibly with the aid of pusher means which are preferably provided. Action by the operator is therefore effectively reduced to the indispensable minimum, and in particular, he is required to exert no particular skill and no strength, which under unfavourable circumstances could have led to considerable drawbacks.

The characteristics and advantages of the present invention will be more apparent from the detailed description of one possible embodiment thereof given hereinafter and illustrated by way of example in the accompanying drawings, in which.

Figure 1:
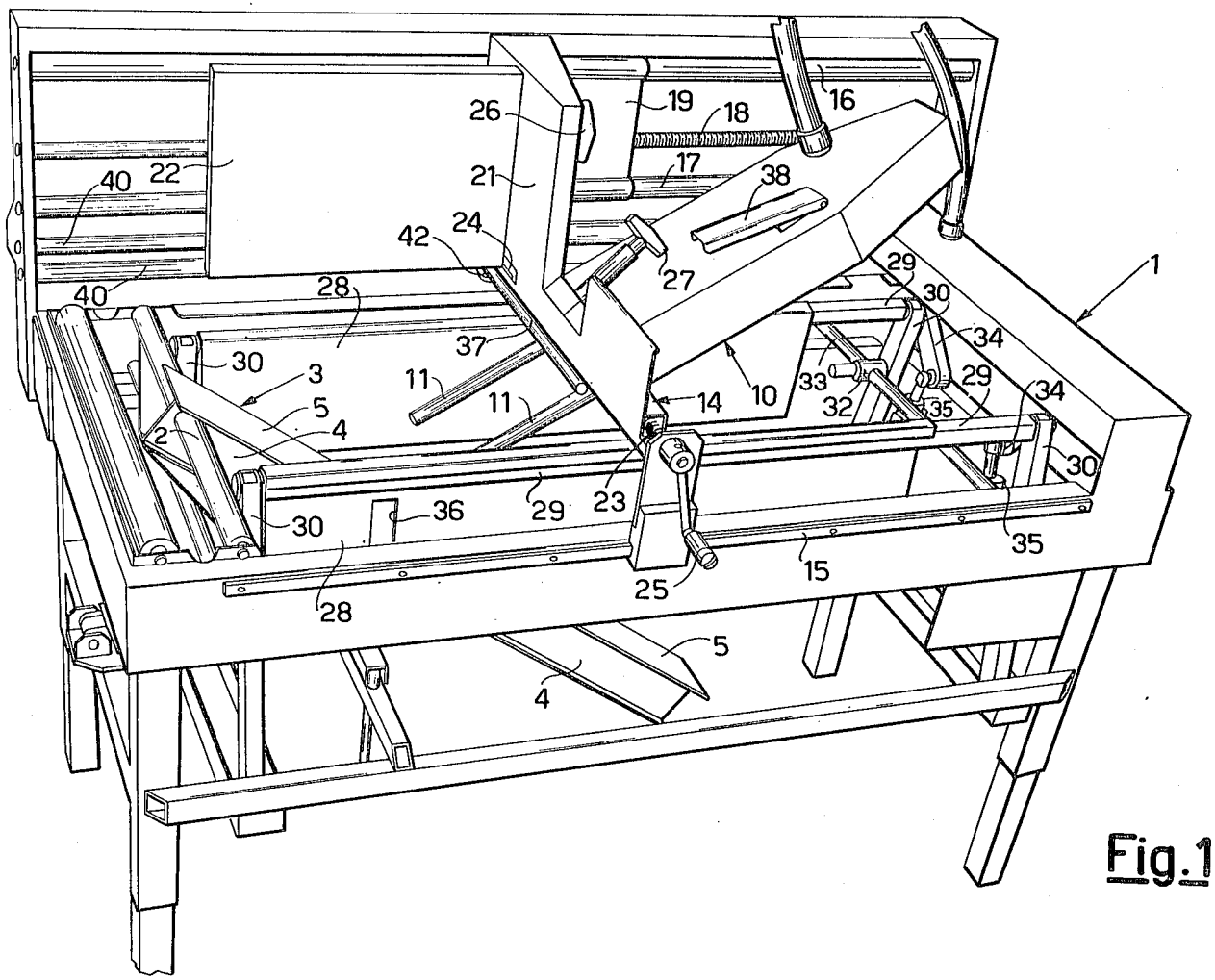
FIG. 1 is a perspective view of a machine according to the invention in the rest position.
Figure 2:
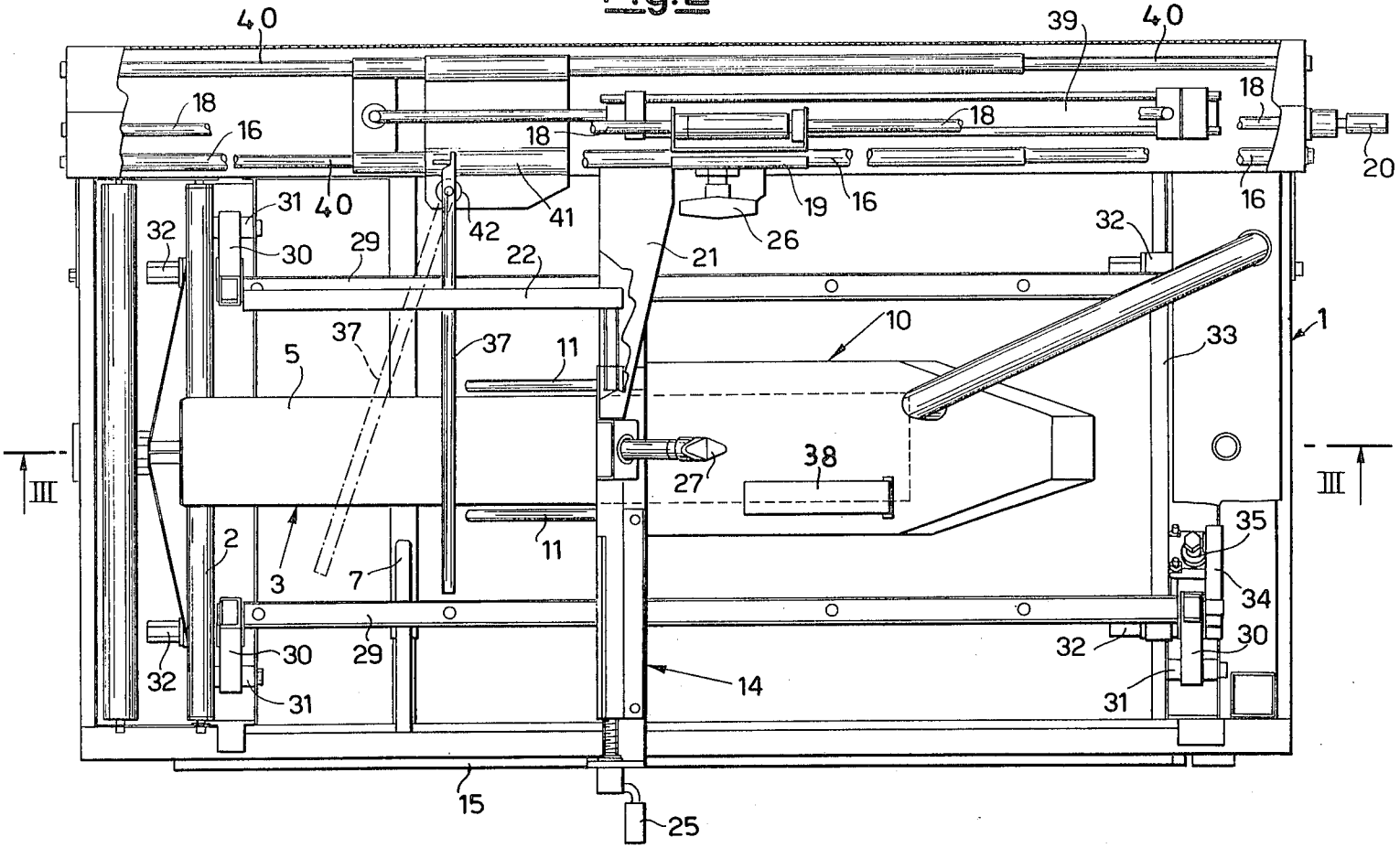
FIG. 2 is a plan view of said machine from above.
Figure 3:
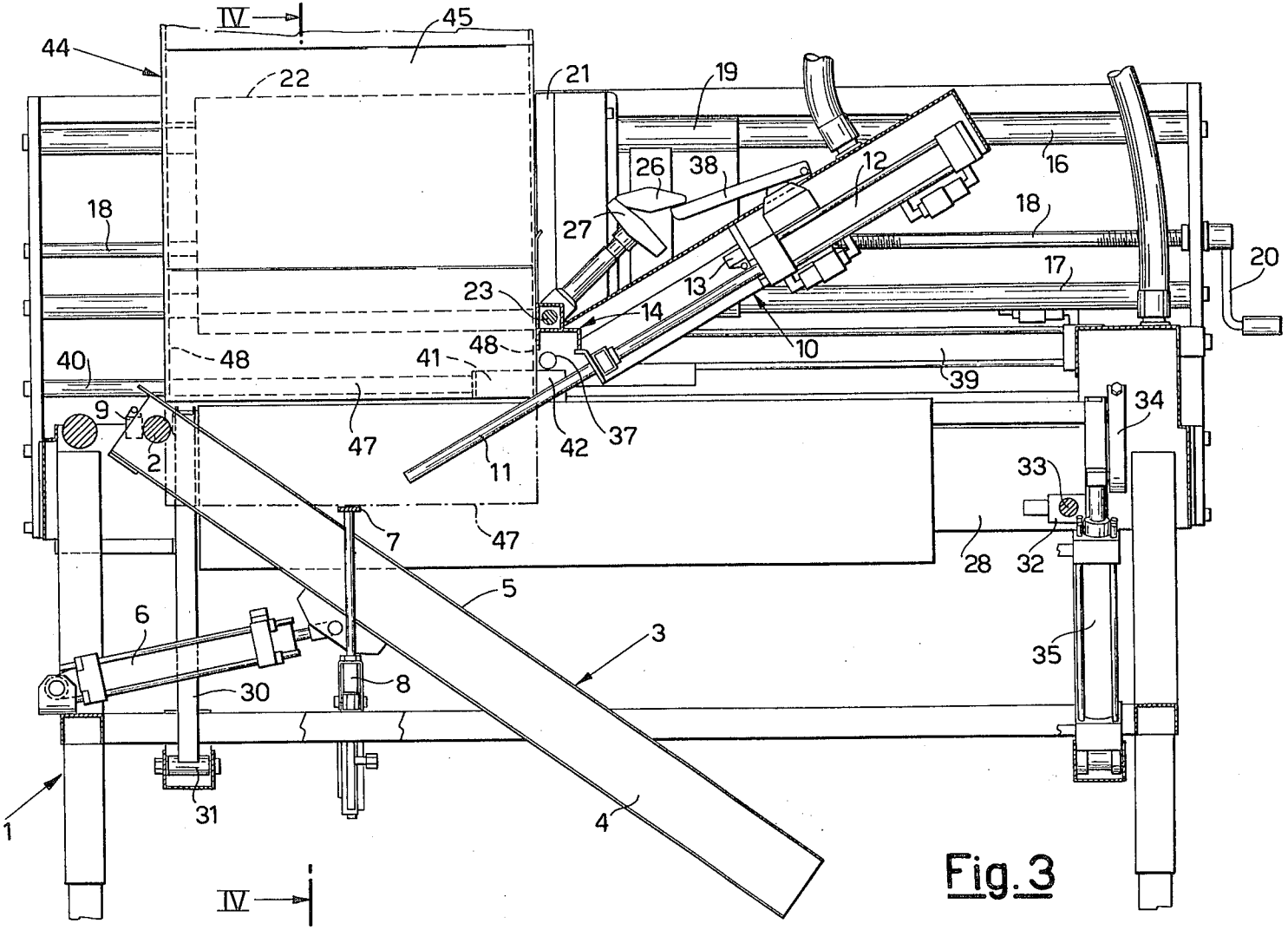
FIG. 3 is a longitudinal section through said machine on the line III—III of FIG. 2.
Figure 4:
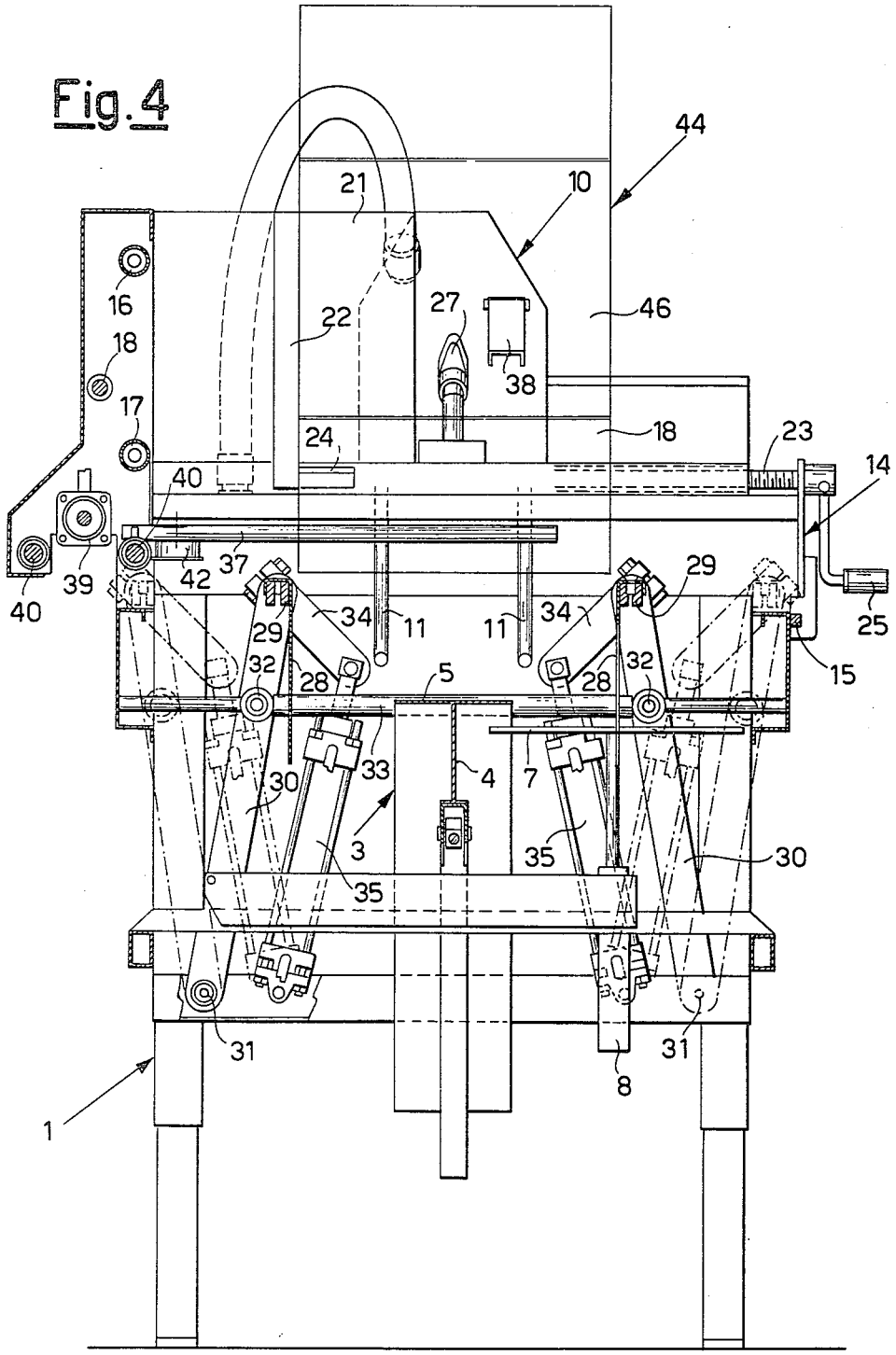
FIG. 4 is a cross-section through said machine on the line IV—IV of FIG. 3.

FIGS. 1 to 7 show a machine comprising a base frame 1, to one end of which there is hinged at 2 (FIGS. 1, 2, 3, 5 and 6) a T section 3 formed from a vertical lower branch 4 and an upper branch 5 (FIG. 4). A pneumatic cylinder 6, controlled by a sensitive rod 7 urged upwards by suitable resiliently yieldable means housed in a fixed cylinder 8 (FIGS. 3 and 4), rotates the section 3, when required, from its rest position in FIG. 3, in which its upper branch 5 is inclined downwards, to its working position of FIG. 6, in which its upper branch 5 extends horizontally. A pneumatic limit switch 9 (FIGS. 3 and 6) is fixed to the base frame 1 in such a manner as to sense the arrival of the section 3, or rather its upper branch 5, in said working position.

In front of the T section 3, and supported by a support structure 10, there are disposed two parallel bars 11 which are located at a distance apart such as not to hinder the rotation of the section 3 towards its working position. As can be deduced from FIGS. 3 and 6, the bars 11 can be displaced axially from a rest position (FIG. 3) in which they extend obliquely from the support structure 10 and converge as a V towards the section 3, to a working position (FIG. 6) in which they are almost completely withdrawn into the support structure 10. This movement is produced by a pneumatic cylinder 12 when controlled in this sense by said limit switch 9. A further limit switch 13 is associated with the bars 11 in order to sense their arrival in their working position.

Figure 5:
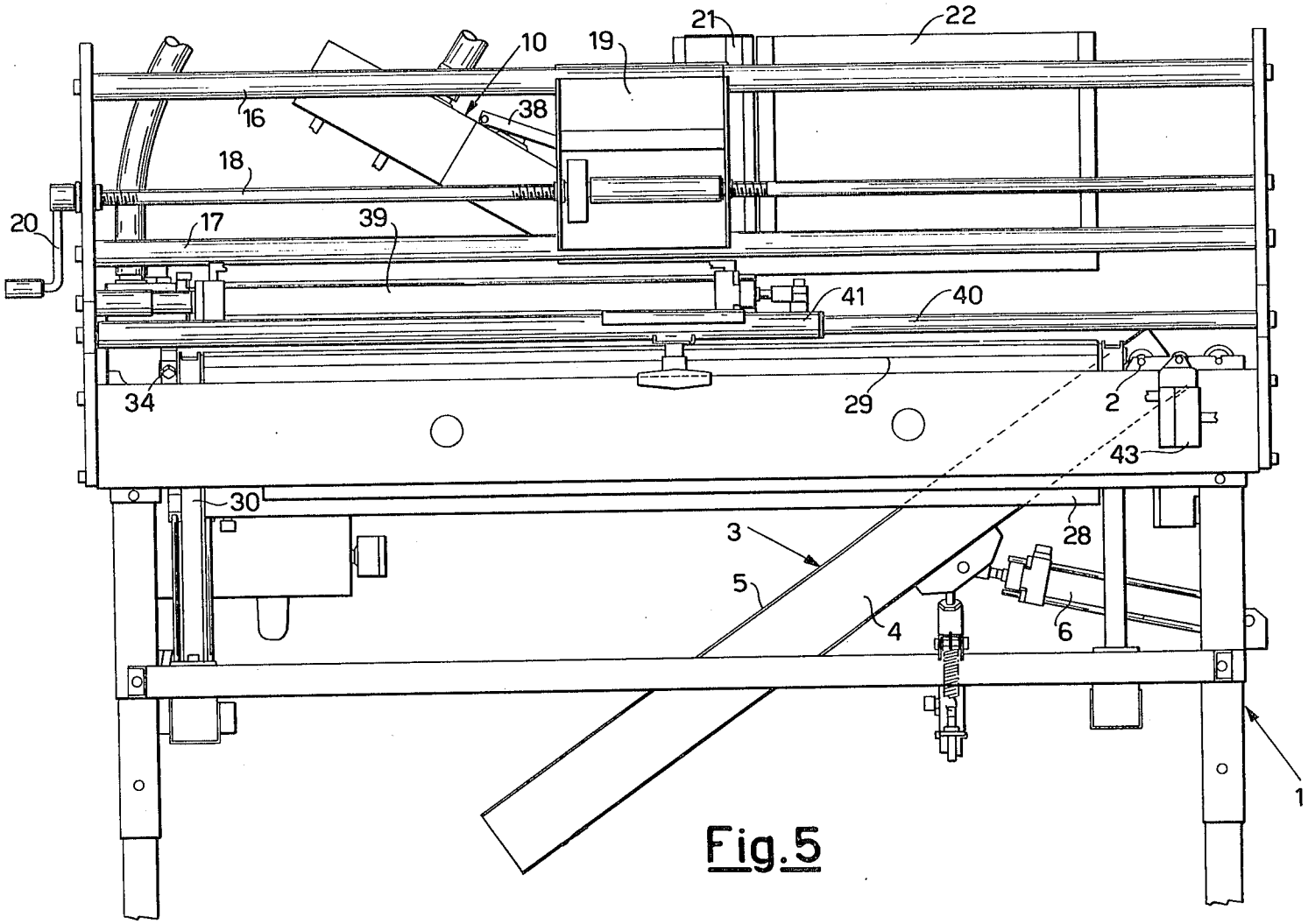
FIG. 5 is a rear view of said machine relative to FIG. 3.
Figure 6:
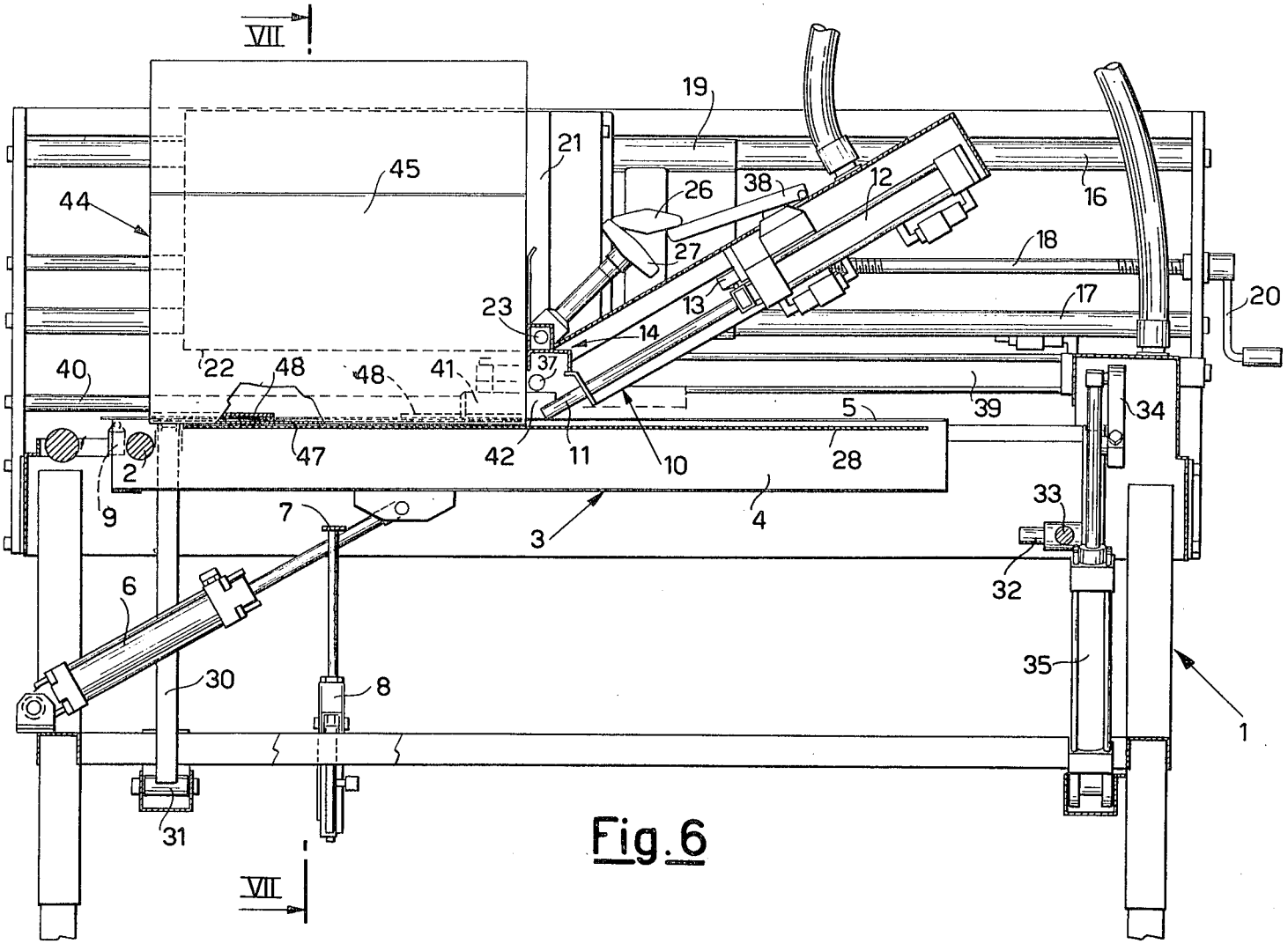
FIG. 6 is a longitudinal section similar to FIG. 3, with the machine in the position in which it has completely closed a box.

The support structure 10 is connected to a bridge structure 14, the position of which is adjustable along longitudinal slide guides 15, 16 and 17, according to the box length, by means of a screw 18 which engages with a part 19 of said bridge structure 14, and can be operated by a handle 20 (FIGS. 3, 5 and 6). A front stop wall 21 is rigid with the bridge structure 14 and forms an angle with a lateral wall 22 which moves longitudinally to the machine together with the bridge structure 14, and can also be moved transversely to the machine, according to the box width, by means of a screw 23 which engages with a section 24 rigid with the part 22 (FIGS. 4 and 7) and operable by means of a handle 25. The bridge structure 14 can be locked along the guides 15 to 17 by a clamp 26, and the lateral wall 22 can be locked along the bridge structure 14 by a clamp 27.

Figure 7:
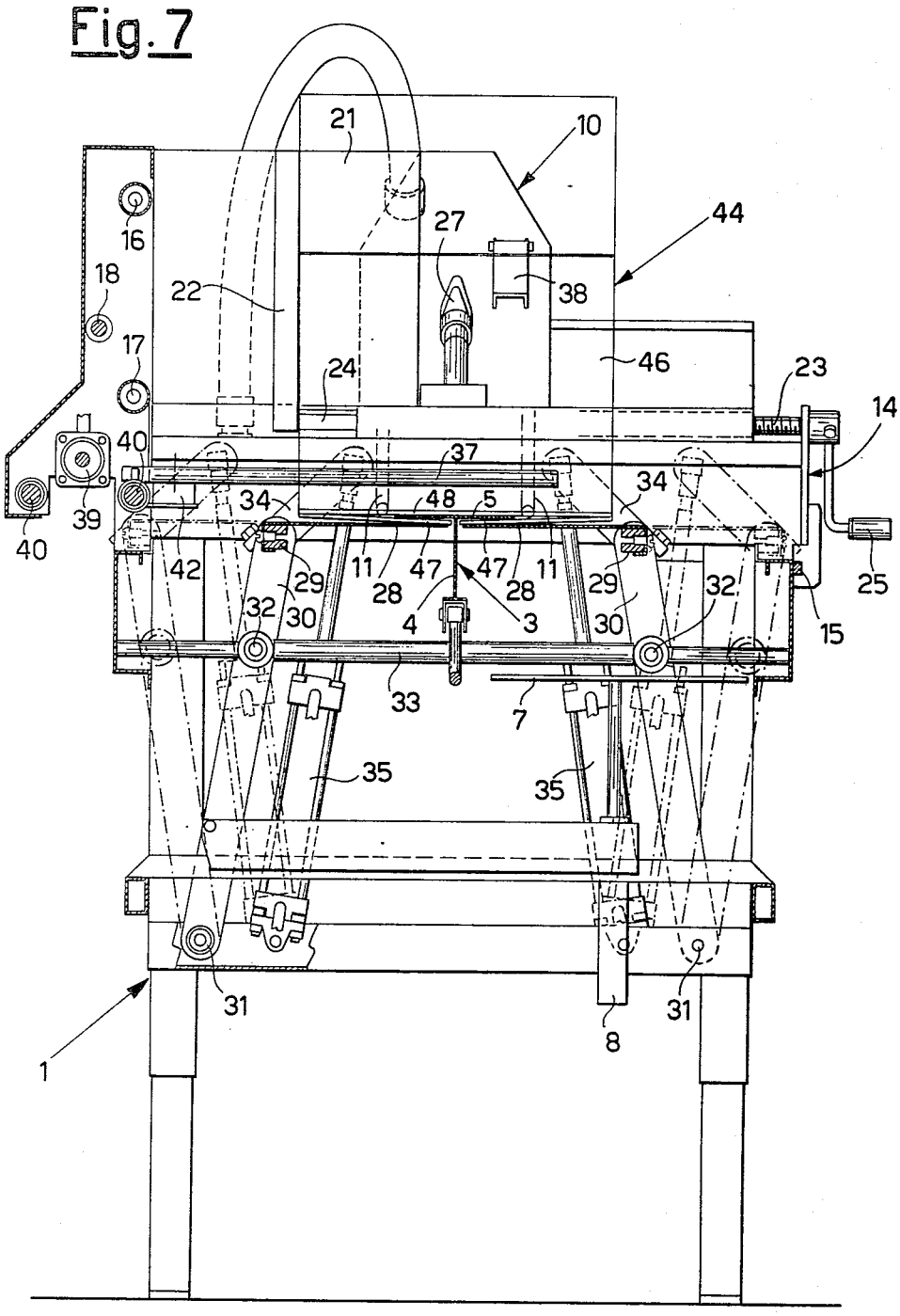
FIG. 7 is a cross-section through the machine in said position in which it has closed the box, taken on the line VII—VII of FIG. 6.

Two lateral plates 28 are disposed to the two sides of the T section 3 and of the pair of bars 11, between the hinging pin 2 of the section 3 and the bridge structure 14, and are rotatable rigidly with respective parallel longitudinal pins 29, in such a manner as to be able to be rotated from a rest position in which said plates extend vertically as shown in FIG. 4 to a working position shown in FIG. 7, in which said plates converge horizontally towards the section 3, so that when the section is in its working position they become disposed below its upper branch 5 and to the sides of its lower branch 4. As shown in FIGS. 4 and 7, the hinging pin 29 of each plate 28 is supported rotatably at each end by a respective arm 30 hinged at 31 to the base frame 1 and adjustable angularly, according to the box width, by displacing its locking point 32 along a guide bar 33. FIGS. 4 and 7 show the two extreme adjustment positions by a full line and a dashed and dotted line. The pins 29, and thus the plates 28, are rotated by handles 34 moved by respective pneumatic cylinders 35 which are caused to elongate by said limit switch 13. As can be seen from FIG. 1, one of the two plates 28 is provided with a vertical slot 36, in which the sensitive rod 7 is housed when the plates are at rest.

The machine also comprises an expulsion bar 37, which from its rest position (FIGS. 1 to 5) in which it extends transversely to the machine in the immediate proximity of the bridge structure 14, can be moved along the machine axis (FIG. 2) towards the end at which the hinging pin 2 of the T section 3 is provided. This movement is made by a lever 38 mounted on the structure 10, and is produced by the elongation of a pneumatic cylinder 39 (FIGS. 2 and 5) which causes a carriage 41 carrying a support 42 for the expulsion bar 37 to slide along longitudinal guides 40. The expulsion bar 37 is rotatably mounted on said support 42, with a spring for returning it into its normal position perpendicular to the longitudinal axis of the machine in order to prevent injury to an operator who might accidentally insert his hand between the bar 37 and bridge structure 14. A limit switch 43 (FIG. 5) senses the maximum advancement of the carriage 41, and thus the end of the expulsion stroke of the bar 37, on which it causes the various cylinders 6, 12, 35 and 39 to return to their rest position.

Before using a machine such as that shown on the drawings for closing the lower flaps of a parallelepiped box with foldable flaps, namely a box 44 having two major sides 45, two minor sides or ends 46, two lower side flaps 47 and two lower end flaps 48 as indicated in FIGS. 3, 4, 6 and 7, it is obviously necessary to adjust the position of the wheels 21 and 22 by means of the handles 20 and 25, in such a manner as to enable the operator to correctly position the box relative to the section 3 by disposing a minor side of the box against the wall 21 and a major side against the wall 22. It is also necessary to seek the most suitable position between the two extreme positions of FIG. 4 to act as the rest position for the lateral plates 28. The adjustment is made in accordance with the length and width of the boxes to be closed.

After making this adjustment, a box 44 is disposed in the predetermined position above the region occupied by the section 3 and bars 11, and is lightly pushed downwards so as to enable the end flaps 48 to begin to rotate towards their closed position by the action of the converging inclined surfaces constituted by the upper branch 5 of the section 3 and by the bars 11, and at the same time to enable one of the side flaps 47 to reach and operate the sensitive rod 7 (position illustrated by the dashed and dotted line in FIG. 3). At this point, the work of the operator terminates because the machine now automatically carries out all further operations, including the complete closure of the lower flaps of the box and retaining this latter in a stable position suitable for its filling. In this respect, operation of the sensitive rod 7 causes the cylinder 6 to extend, and this rotates the section 3 towards its working position of FIGS. 6 and 7, with consequent engagement and closure of the end flaps 48. As soon as the section 3 has reached this working position, the limit switch 9 causes the cylinder 12 to shorten so as to withdraw the bars 11 into their retracted position in which (FIG. 6) the limit switch causes the cylinders 35 to extend so as to rotate the plates 28 and consequently close the side flaps 47 (FIG. 7).

At this point the machine stops with the box 44 retained in a position suitable for its filling, and with its lower flaps closed. When filling is terminated, the operator has merely to operate the lever 38 to make the cylinder 39 advance the bars 37, which engage with the side of the box in contact with the wall 21 to slide the box towards the loading end (the end comprising the pin 2), and thus discharge the box. Finally, the limit switch 43 returns all the machine members to rest.

Figure 8:
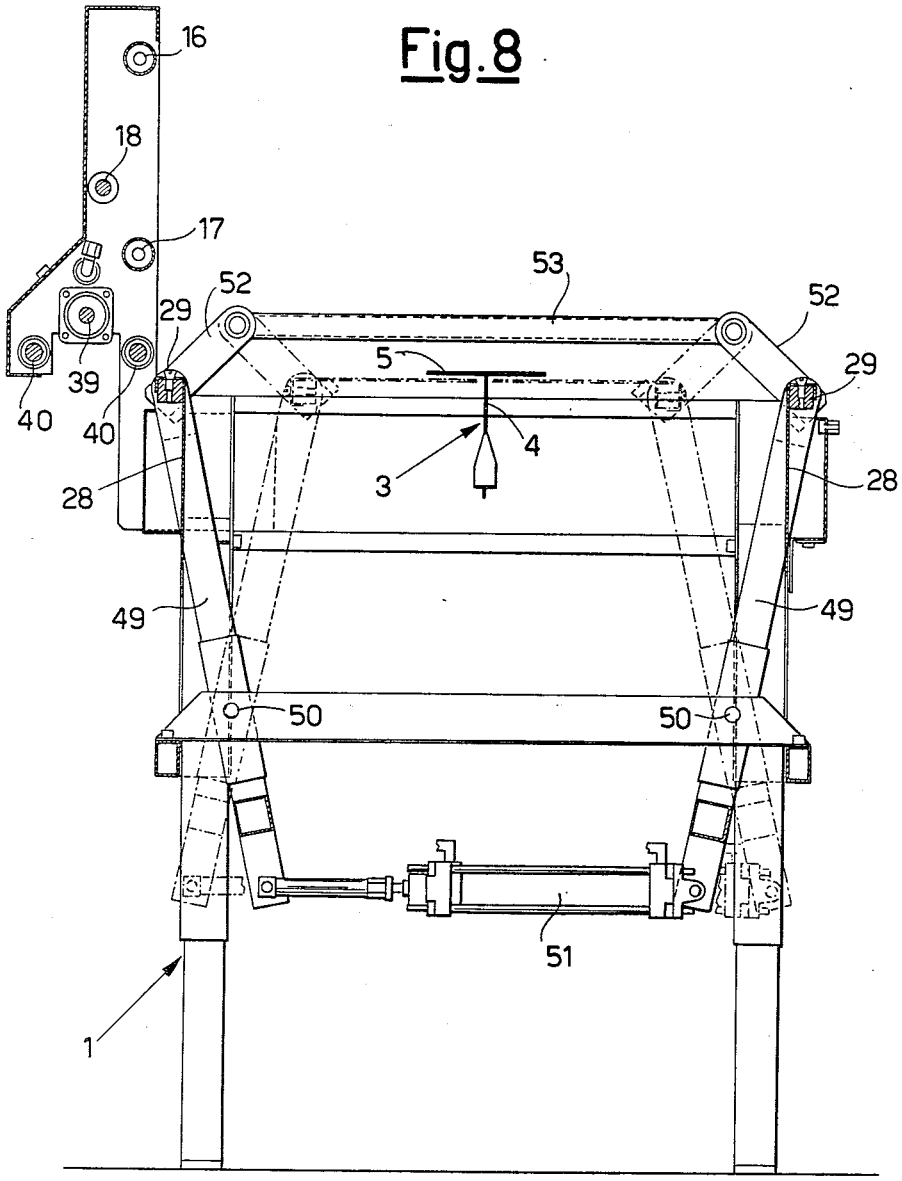
FIG. 8 is a section similar to FIG. 7, showing a modification of the machine of the previous figures.

Various modifications can be made to the machine of FIGS. 1 to 7 without leaving the scope of the invention. One of these is for example that illustrated in FIG. 8, which has the merit of dispensing with the initial adjustment of the position of the plates 28. The two pins 29 are rotatably supported by arms 49 rotatable at 50 under the control of a pneumatic cylinder 51 which connects the arms 49 together, and are rigid with cranks 52 which are connected together by bars 53. Consequently, starting from a rest position such as that shown in full lines in which the plates 28 are at their maximum distance apart, the cylinder 51 moves the pins 29 and plates 28 with rotary and translatory movement towards the working positions suitable for any box width, as illustrated by dashed and dotted lines.

I claim:

1. An automatic machine for closing the lower flaps of a parallelepiped box with foldable flaps, and for then retaining the box in a suitable filling position, comprising a T section with a vertical lower branch, which can be rotated from a rest position in which said upper branch is inclined downwards, to a working position in which said upper branch extends horizontally, a pair of parallel bars disposed in front of said section at a distance apart such as not to hinder the rotation of the section and which themselves can be axially displaced from a rest position in which said bars extend obliquely from a support structure converging towards said section, to a working position in which said bars are withdrawn towards said spport structure, a pair of lateral plates rotatable from a rest position in which said plates are disposed vertically to the sides of said section and said bars, to a working position in which said plates converge horizontally towards said section so that when the section is in its working position said plates are disposed below the upper branch and to the sides of the lower branch of said section, first sensitive means which, when a box with its lower flaps open is arranged above said section and said bars such that the major sides of the box are in planes parallel to the axes of said section and said bars, responds so as to cause said section to rotate from said rest position to said working position in order to close the end flaps of the box, second sensitive means which, when the section rotates into said working position, respond so as to cause said bars to move from said rest position to said working position, and third sensitive means which, when said bars move into said working position, respond so as to cause said lateral plates to rotate from said rest position to said working position in order to close the side flaps of the box under said end flaps.

2. A machine as claimed in claim 1, comprising pusher means which can be controlled so that said pusher means engage with a minor side of the box in order to expel it after filling.

3. A machine as claimed in claim 2, comprising sensitive means which, when the box is expelled, respond so as to cause said section, said bars, said lateral plates and said pusher means to return to their respective rest positions.

4. A machine as claimed in claim 1, comprising adjustable means for initially positioning the box in a predetermined position suitable for the closure of the lower flaps.

5. A machine as claimed in claim 1, wherein said lateral plates are provided with rotation pins at an adjustable fixed distance apart.

6. A machine as claimed in claim 1, wherein said lateral plates are provided with rotation pins which are in their rest position when withdrawn from each other, and are caused to approach each other simultaneously with the rotation of said plates towards their working position.

* * * * *